US005823536A

United States Patent [19]

Flasch

[11] Patent Number: 5,823,536

[45] Date of Patent: Oct. 20, 1998

[54] BLACKJACK CARD GAME AND METHOD OF PLAYING A GAME

[76] Inventor: Leo Flasch, 109 Beresford Dr., Egg Harbor Township, N.J. 08234

[21] Appl. No.: 866,768

[22] Filed: May 30, 1997

[51] Int. Cl.[6] ..... A63F 1/00

[52] U.S. Cl. ..... 273/292

[58] Field of Search ..... 273/292, 309, 273/274; 463/12

[56] References Cited

U.S. PATENT DOCUMENTS

| | | | |
|---|---|---|---|
| 5,013,049 | 5/1991 | Tomaszewski | 273/292 |
| 5,072,946 | 12/1991 | Miller | 273/292 |
| 5,224,706 | 7/1993 | Bridgeman et al. | 463/13 |
| 5,226,661 | 7/1993 | Wolf | 273/274 |
| 5,248,142 | 9/1993 | Breeding | 273/138.1 |
| 5,249,809 | 10/1993 | Wolf | 273/274 |
| 5,265,882 | 11/1993 | Malek | 273/292 |
| 5,275,415 | 1/1994 | Wisted | 273/274 |
| 5,275,416 | 1/1994 | Schorr et al. | 273/292 |
| 5,314,194 | 5/1994 | Wolf | 273/292 |
| 5,328,189 | 7/1994 | Malek | 273/292 |
| 5,395,119 | 3/1995 | Jacob et al. | 273/274 |
| 5,395,120 | 3/1995 | Malek | 273/292 |
| 5,397,128 | 3/1995 | Hesse et al. | 273/292 |
| 5,411,268 | 5/1995 | Nelson et al. | 273/292 |
| 5,413,353 | 5/1995 | Demarest et al. | 273/292 |
| 5,494,296 | 2/1996 | Grassa | 273/292 |
| 5,503,401 | 4/1996 | Nguyen | 273/306 |

OTHER PUBLICATIONS

"Super Blackjack", Gaming Concepts, Inc., 1993.

"21st Century Blackjack", Gaming Concepts, Inc., 1994.

Affidavit of Ronald C. Black, Captain, County of Los Angeles, Sherriff's Department Headquarters, "California Catch 22"., Mar. 1995.

Affidavit of De Witt W. Clinton, County Council, County of Los Angeles, Office of the County Council, "California Catch 22"., Apr. 1995.

*Primary Examiner*—Benjamin H. Layno

*Attorney, Agent, or Firm*—James J. Murtha; Thomas A. Lennox

[57] ABSTRACT

A method of playing casino blackjack is provided where players receive a card point total equaling the point value of numbered cards, ten points for face cards and one or eleven points for aces. Players and a dealer are positioned in an order at a table. Each player, in turn, is offered the role of banker until a first player accepts. A wager is provided by each player, excluding the banker. Initial two-card blackjack hands are dealt by the dealer to the players, including the banker and excluding the dealer, in order starting from a player adjacent to the banker. Each player is allowed to receive additional cards from the dealer, at the player's option or until the player exceeds a card point total of twenty-one, starting from the player adjacent to the banker. The banker collects the wagers of any player receiving a card point total over twenty one. Each remaining players' hands are compared with the hand of the banker and the player's hand is designated as a winner or a loser in accord with the rules of blackjack, wherein for the purposes of comparison, the banker is deemed to be the house. The banker pays off the players with winning hands in accord with the rules of blackjack. The banker collects the wagers of the players with losing hands. The banker pays the dealer a vigorish on any net wagers collected by the banker.

20 Claims, 1 Drawing Sheet

BLACKJACK CARD GAME AND METHOD OF PLAYING A GAME

BACKGROUND OF THE INVENTION

This invention is directed to the field of casino card games. In particular, the invention is directed to a method of playing a modified form of blackjack in which the players have the opportunity to play the role of a banker.

Casino gaming has become more popular over the last several years as numerous states have begun to legalize gambling, at least to some degree. One of the most popular games is blackjack or twenty-one. The game of blackjack is fairly straightforward such that it is easy to learn but has many subtleties such that it is interesting even for experienced players. Further, the game of blackjack provides relatively good odds for the players compared to other casino games.

In the game of blackjack, the players are positioned around a table. A dealer, who is a casino employee, generally stands at the side of the table opposite the players. The dealer deals cards to each player and himself (or herself), starting from the player on his immediate left, until each player and the dealer have two cards (that is, an initial hand). The players cards are typically dealt face down while the dealer's cards are dealt one face down and one face up. The numbered cards are worth their face value. The face cards are worth 10. Aces are worth 1 or 11, at the option of the player. The player's object is to reach a card point total of 21, or to come as close as possible without exceeding 21.

If the player receives a card point total of less than 21, he must decide whether to accept additional cards (that is, "to hit") or whether to refuse another card (that is, "to stand"). If the player receives another card and obtains a card point total over twenty-one, he "busts" and his wager is lost to the dealer. Eventually, the player is satisfied with his hand and stands, receiving no more cards. The card point total of this hand is compared with the card point total of the hand held by the dealer.

If the dealer has a card point total of 16 points or less, he must take another card. If the dealer has a card point total of 17 points or more, he must stand. If the dealer's card point total exceeds 21, any player who has not busted wins an amount equal to his wager.

If neither the player nor the dealer busts, the card point total of the player is compared to the card point total of the dealer. If the player has a higher card point total, he wins a wager from the dealer equal to his original wager (with one exception for dealer blackjack, described below). If the dealer has a higher card point total than the player, the player's wager is lost to the dealer. If the dealer and the player have the same card point total, the hand is a "push" (that is, a tie) and the player retains his original wager.

If the player receives a card point total of twenty-one (that is, an Ace in combination with a 10 point card, referred to as a "natural" or "blackjack") on the first two cards dealt (that is, his initial hand), he obtains an amount from the dealer at three to two odds based on his original wager, assuming the dealer does not also draw a 21 card point total on his first two cards (dealer blackjack). If both the player and the dealer draw blackjack, the hand is a push and the player retains his original wager.

There are various options which can be used when playing the game of blackjack. After the initial two cards are dealt, certain casinos allow the player to "double down". In that case, the player upon seeing only his first two cards may double his original bet but must receive one and only one additional card. Certain casinos limit doubling down to instances where the player's card point total is equal to 9, 10 or 11.

When the player receives two cards of the same value in his initial hand, lie may split the pair. Each of those identical cards becomes the first card in a separate hand. The player must provide an additional wager equal to his original wager for the second hand. These new hands are played in accord with the rules as set forth above.

A player may also obtain "insurance". If the dealer has an Ace showing as his face up card, the player may provide an additional wager equal to one half of his original wager. It the dealer ends up drawing blackjack, the player will receive an amount from the dealer equal to twice his insurance bet. Consequently, although he has lost his original wager to the dealer's blackjack, he ends up even because of the successful insurance wager.

While the game of blackjack is one of the most popular casino games, certain players would be more interested in the game if they could receive the beneficial odds provided to the dealers. However, any modification of the existing game may result in a drastic change of odds, perhaps making the game less interesting or less profitable to the players. Further, other players prefer to play blackjack in its more traditional form. These players may refuse to play a game that diverges widely from the existing version.

Various attempts to provide interesting games have been made in the past. U.S. Pat. No. 5,275,415 is directed to a card game using a 56 card deck including a traditional deck with four jokers. The traditional 52 card deck can also be used by itself. A casino employee acts as a dealer and does not receive cards. One player is designated the "dealer" by the roll of dice, etc. This role of "dealer" rotates around the table after each hand. The players place their identical wagers at the center of the table in a pot of which the house takes a certain percentage or "rake." The players are dealt two cards face down. After looking at their cards, the players can request additional cards, starting from the player to the left of the designated player/dealer. The players try to get a card total as close to 22 as possible (either over or under 22). The numbered cards have their face value, the face cards count as 10 points, and aces and jokers count as 1 or 11 points. The player with the score closest to 22 takes the remainder of the pot.

U.S. Pat. No. 5,413,353 is directed to a method of playing a blackjack-type card game. Each player places an identical wager into a pot. The dealer deals two cards to each player, but receives no cards himself. The players may split pairs, draw additional cards or stand. The player with the best blackjack hand overall takes the pot. If two or more players tie, the pot is divided or the game is declared a Lie and cards are redealt.

U.S. Pat. No. 5,265,882 is directed to a method and apparatus of playing a new casino game. The players play against the dealer and the other players in modified versions of "21", Draw Poker and Baccarat. The house collects a 5% commission from the pot.

None of these games permit the players the option of taking advantage of the favorable odds generally reserved for the house or playing blackjack in a traditional fashion, at the player's option.

SUMMARY OF INVENTION

It is an object of an aspect of the invention to provide a method of playing a casino card game which permits the players to obtain some of the statistical advantage reserved for the casino while preserving the integrity of the traditional blackjack game.

It is a further object of an aspect of the invention to provide a method of playing blackjack which permits the player to play the role of banker, either with or without the support of the casino, while other players are permitted to play traditional blackjack.

It is a further object of an aspect of the invention to provide a method of playing blackjack which permits the players flexibility, allowing doubling down, splitting pairs, and the like.

It is a further object of an aspect of the invention to provide a method of playing blackjack which while permitting unique variations, allows the dealer to play the traditional role of the casino or house, at least for selected hands.

In accord with one aspect of the invention, a method of playing a casino card game is provided. A selected number of players between one and seven players are positioned around a table. A dealer is positioned at the table among the players. One of the players is selected to act as banker. Each of the players except the banker is required to make a wager. Hands are dealt by the dealer consecutively to all the players including the banker, starting from a player directly adjacent to the banker such that each player and the banker have hands including two initial cards. Each player obtains a card point total determined by the summation of the value of the cards in his hand, wherein numbered cards are worth their face value, face cards are worth ten and aces are worth one or eleven. Each player starting with the player directly adjacent to the banker, is allowed to receive additional cards in his hand, one at a time, thereby affecting his card point total until the player elects to receive no more additional cards or until the player's card point total exceeds twenty-one. The banker must elect to receive an additional card if his card total is less than 17 and wherein the banker must stand if his card total is greater than 16. The player has a winning hand if his card point total is less than twenty-two and is closer to twenty one than the card point total of the banker. The game is a tie if the player and the banker have the same card point total less than twenty-two unless the player or the banker has a card point total of twenty-one based solely on the initial cards. The player has a losing hand if he has a card point total over twenty-one or if his card point total is further from twenty-one than the card point total of the banker. The banker pays the players with winning hands in accord with traditional blackjack payoff rules. The banker collects the wagers from the players with losing hands. A vigorish is determined based, at least in part on all wagers collected by the banker from the players. The vigorish is paid to the dealer.

Certain implementations of this aspect of the invention provide that: the initial cards are dealt to the players face down and at least one of initial cards are dealt to the banker face up; the initial cards to the players are dealt face up and at least one of the initial cards are dealt to the banker face up; the initial cards are dealt to the dealer face up, all ties are won by the banker, and the player receives a payoff at one-to-one odds for a winning blackjack hand; the dealer pays a predetermined portion of the bets won by the players and collects a predetermined portion of the bets lost by the players; a player with a matching pair of cards in his initial two cards is permitted to split the pair into two separate new hands, each new hand including one of the two cards of the pair; the player is permitted to double his wager after receiving his initial cards and dealing the player only one additional card; a first hand is included having a wager required from all the players, an initial two-card hand dealt by the dealer to the players and the dealer, each player is allowed to receive additional cards from the dealer, at the player's option or until the player exceeds a card point total of twenty-one, the dealer collects the wagers of any player receiving a card point total over twenty-one, each remaining players' hands is compared with the hand of the dealer and designating the player's hand as a winner or a loser in accord with the rules of blackjack, the dealer pays off to the players with winning hands in accord with the rules of blackjack, the dealer collects the wagers of the players with losing hands.

In accord with another aspect of this invention, a method is provided for playing a version of blackjack with a dealer and a plurality of players positioned about a table in an order with respect to the dealer. The method includes offering each player, in turn, from a position adjacent to the dealer, the role of banker until a player accepts the banker's role. The accepting player is designated as banker. Each of the players excluding the banker is required to make a wager. An initial two card blackjack hand is dealt by the dealer to each player and the banker starting from a player directly adjacent to the banker. Each player, starting with the player directly adjacent to the banker, is allowed to play out his blackjack hand against the banker wherein the banker plays according to rules traditionally associated with a casino. The banker pays the players with winning hands in accord with traditional blackjack payoff rules. The banker collects wagers from the players with losing hands. A vigorish is determined as a predetermined portion of all net wagers collected by the banker from the players. The vigorish is collected by the dealer. Each player, in turn, from a position adjacent to the dealer, is again offered the role of banker until a player accepts the banker's role.

Certain implementations of this aspect of the invention provided that: the initial cards are dealt to the players face down and at least one of initial cards are dealt to the banker face up; the initial cards to the players are dealt face up and at least one of the initial cards are dealt to the banker face up; the initial cards are dealt to the banker face up, all ties are won by the banker, and the player receives a payoff at one-to-one odds for a winning blackjack hand; the dealer pays a predetermined portion of the bets won by the players and collects a predetermined portion of the bets lost by the players; a player with a matching pair of cards in his initial two cards is permitted to split the pair into two separate new hands, each new hand including one of the two cards of the pair; the player is permitted to double his wager after receiving his initial cards and dealing the player only one additional card; a first hand is included having a wager required from all the players, an initial two-card hand dealt by the dealer to the players and the dealer, each player is allowed to receive additional cards from the dealer, at the player's option or until the player exceeds a card point total of twenty-one, the dealer collects the wagers of any player receiving a card point total over twenty-one, each remaining players' hands is compared with the hand of the dealer and designating the player's hand as a winner or a loser in accord with the rules of blackjack, the dealer pays off to the players with winning hands in accord with the rules of blackjack, the dealer collects the wagers of the players with losing hands.

In accord with another aspect of the invention, a method of playing casino blackjack is provided where players receive a card point total equaling the point value of numbered cards, ten points for face cards and one or eleven points for aces. A plurality of players are positioned in an order at a table. A dealer is positioned at the table among the players. Each player, in turn, is offered the role of banker until a first player accepts. The first player is designated as banker. A wager is provided by each player, excluding the banker. Initial two-card blackjack hands are dealt by the dealer to the players, including the banker and excluding the dealer, in order starting from a player adjacent to the banker. Each player is allowed to receive additional cards from the dealer, at the player's option or until the player exceeds a card point total of twenty-one, starting from the player adjacent to the banker. The banker collects the wagers of any player receiving a card point total over twenty-one. Each remaining players hands are compared with the hand of the banker and the player's hand is designated as a winner or a loser in accord with the rules of blackjack, wherein for the purposes of comparison, the banker is deemed to be the house. The banker pays off the players with winning hands in accord with the rules of blackjack. The banker collects the wagers of the players with losing hands. The banker pays the dealer a vigorish on any wagers collected by the banker.

Certain implementations of this aspect of the invention provide that the method include a first hand having a wager required by all the players. An initial two-card hand is dealt by the dealer to the players and the dealer. Each player is allowed to receive additional cards from the dealer, at the player's option or until the player exceeds a card point total of twenty-one. The dealer collects the wagers of any player receiving a card point total over twenty-one. Each remaining players' hands are compared with the hand of the dealer and the player's hand is designated as a winner or a loser in accord with the rules of blackjack. The dealer pays off the players with winning hands in accord with the rules of blackjack. The dealer collects the wagers of the players with losing hands.

DESCRIPTION OF PREFERRED EMBODIMENTS

Figure 1:
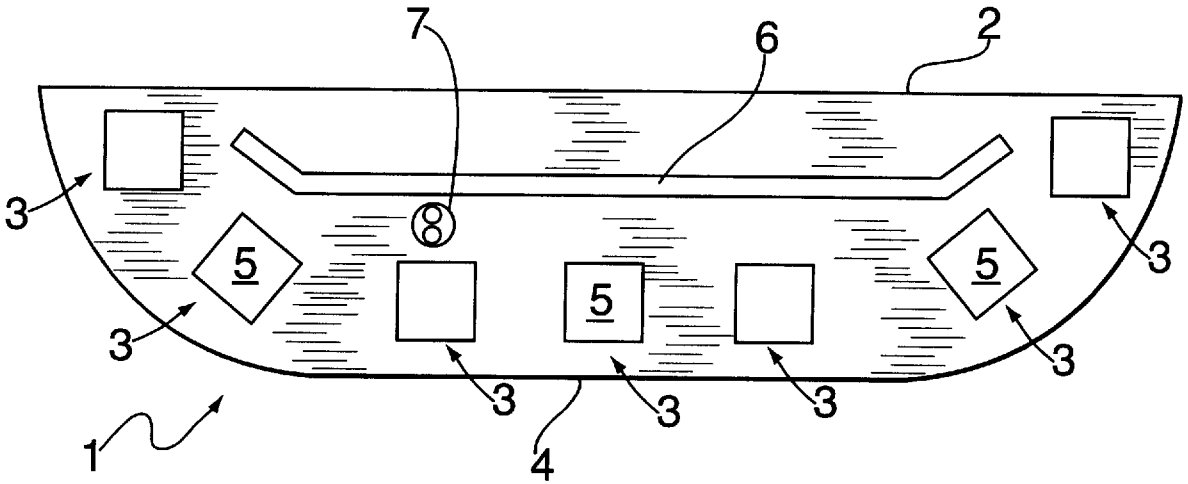
FIG. 1 is a top elevation view of a table for use with the game of the instant invention.

FIG. 1 is a top view of a casino gaming table 1 for use with the instant invention. The table preferably has a half-moon shape. The dealer is positioned along the straight edge 2 of the table. Seven player positions 3 are located along the curved edge 4 of the table. A bet region 5 is located on the table for each player position. An insurance line 6 extends across the table in front of each card region. It will he appreciated that the gaming table may be modified and still practice the invention. In particular, more or less player positions can be provided, and the insurance line may be eliminated. Further, the card regions can have various shapes or be eliminated all together.

The game in accord with the current invention is played with one or more traditional 52 card decks. There are no jokers or other special cards. In certain variations, several traditional 52 card decks may be combined to form a single deck. For example, it may be desirable to combine six decks and load them all into a shoe from which the dealer deals the cards. This will limit the need to reshuffle the cards after every hand. Alternatively, the cards of a single 52 card deck may be shuffled after every hand.

The first hand of the game proceeds as in traditional blackjack. The players make a wager. The dealer starts dealing cards to the players who have made a wager, starting from the player on the immediate right of the dealer, and to the dealer himself. Each player receives a total of two initial cards which are preferably dealt face up. The dealer's cards are dealt, one face up and one face down.

Each player and the dealer have a card point total determined by the cards held in their hand. Numbered cards have a point equal to their face amount. Face cards are worth ten points. Aces are worth eleven points or one point, at the option of the player. The player may receive additional cards dealt face up such that his card point total approaches or equals twenty one. If the player exceeds twenty one, he "busts" and loses his wager to the dealer. The dealer must receive additional cards if his card point total is less than seventeen. The dealer must stand if his card point total is over sixteen.

After the players and the dealer have stopped receiving cards or have gone bust, the hand of each player is compared with the hand of the dealer. If the hand of the player is closer to twenty one than the hand of the dealer, the player wins. If the hand of the dealer is closer to twenty one than the hand of the player, the dealer wins. If the player has a card point total of twenty one or less, and the dealer busts, the player has a winning hand. If the dealer and the player have cards totaling the same amount, it is a tie or a "push" and the player does not lose his wager. An exception to this Is that a two-card combination of twenty one defeats a three or more card combination totaling twenty one.

If the player receives a card point total of 21 after receiving his first two cards and the dealer does not receive a card point total of 21 in his first two cards, the dealer pays off the player at a rate of three to two. Otherwise, if the player has a winning hand, the dealer pays off the bet at one to one odds. If the player has a losing hand, the dealer collects the player's wager.

After the first hand is completed and the wagers collected or paid off, the dealer offers the players the chance to be the "banker", starting from a player adjacent to the dealer. Preferably, the banker role is offered first to the player on the immediate left of the dealer. If this player turns it down, the position is offered to the next players clockwise consecutively down the line along the table. If no one accepts the role of banker, the dealer deals again, as in traditional blackjack. To accept the role of banker, the player must be able to cover four times the wagers of all players (with an exception during co-banking, discussed below). In this way, the banker will be able to cover all wagers made, assuming each player is as successful as possible.

If a player assumes the roll of banker, the dealer places a marker 7 in front of that player's card region. Of course, other types of indicia may be provided, such as a small lights positioned on the table, the light near that player being illuminated. The dealer then deals the cards face up to all the players, starting from a player immediately adjacent to the banker (preferably to the left of the banker). Each player is dealt two initial cards face up as in traditional blackjack. However, no cards are dealt to the dealer. The cards are dealt to the banker one face up and one face down.

Each player plays his hand in accord with the rules of traditional blackjack but the banker is now playing by the rules for the casino (or house). Players receive additional cards until they are satisfied with their hands or until they bust. If the player busts, his wager is moved to the center of the table. The banker must take a card if his card point total is less than seventeen. The banker cannot take an additional card if his card point total is greater than sixteen.

After all the cards are dealt, the hands of the players (those who have not busted) are compared with the hand of the banker. If the banker has a card point total closer to twenty one than the player, the player's wager gets moved to the center of the table 1. If the player has a card point total closer to twenty one than the card point total of the banker, the player has a winning hand and is paid off from any monies in the center of the table. Further, if the player has not busted but the banker has busted, the player is paid off from the center of the table. If the monies in the center of the table are inadequate to cover the payoff to the player, the banker must supply funds himself.

After all of the hands have been paid off, a predetermined portion of the remaining amount is taken by the dealer. Preferably, the dealer takes a commission or vigorish of 5% of the amount remaining in the center of the table. This amount is paid to the casino for operating the game. It will be understood that the amount of the vigorish can be varied from 2% to 15% and still practice the invention but 5% is most preferred. Alternatively, or additionally, a table fee (based on an hourly rate for table usage) can be charged to the players. As another alternative, the banker can be responsible for the losing bets and the vigorish be based on a percentage of the winning bets only.

After the hand has been played to completion, the dealer offers the role of banker to the players adjacent to the current banker. If none of these players are willing to accept the role as banker, the dealer deals the cards in accord with the rules of traditional blackjack. Preferably, in no event is the same player permitted to accept the role of banker for two consecutive hands.

In a variation of the game, the dealer may act as co-banker with the player playing the role of banker. In this variation, the dealer will provide a predetermined portion of every payoff that the banker is required to make. Preferably, the dealer will pay 50% of any payoff required to the players while the banker pays the remaining 50%. The dealer receives 50% of any funds collected from the players for losing hands. The dealer also collects an additional 5% vigorish from any monies collected by the banker.

In accord with the game of the instant invention, the players are permitted to double down. In this case, upon receiving their first two cards, a player may elect to increase his current wager before receiving an additional card (typically, the player can double his original wager). Once the player has elected to double down, he must receive one and only one additional card. At that point, the player must stand with his three card point total. He may not receive another card. If the player has a winning hand compared to the card point total held by the banker, he receives his payoff on the doubled wager. If the player has a losing hand when compared to the card point total of the dealer, he loses the doubled wager to the banker.

The player may also elect to split pairs. If the player receives two matching cards (that is, a pair such as two 8's), he may elect to separate the pair into two separate hands. At that point, he must provide additional funds equal to his original wager for the second hand. The dealer then deals an additional card onto each of the original cards. The player plays each of these hands independently. The player may double down on either of these hands, should he so chouse. At the election of the particular casino, if the player is dealt another card matching one of his original cards, he may elect to split that pair, thereby creating a third distinct and independent hand. Of course, the player must supply an additional wager to support this new hand.

When the banker's face up card is an Ace, a player may make an insurance bet against the banker possibly obtaining a natural. The dealer, before looking at his face down card, inquires whether any of the players would like to make the insurance bet. The players may place an amount equal to ½ the wager on his own hand in the insurance line. If the banker has a natural (that is, blackjack or a 2 card point total of twenty-one), the insurance bet is paid off at a rate of two to one. Consequently, the player effectively does not lose his original wager. However, if the banker does not have a natural, the player loses his insurance bet.

In variations of this game, the cards to the players may be dealt face down. Further, the cards to the dealer may both be dealt face up. In that case, the odds are changed such that the payoff to a player receiving blackjack is only one to one (not three to two as in the traditional game) and the banker wins all ties.

While this invention has been described with reference to specific embodiments disclosed herein, it is riot confined to the details set forth and the patent is intended to include modifications and changes which may come within and extend from the following claims.

I claim:

1. A method of playing a casino card game comprising:

providing at least one standard deck of 52 playing cards;

positioning a selected number of players between one and seven players around a table;

positioning a dealer employed by the casino at the table among the players;

selecting only one of the players to act as banker;

requiring each of the players except the banker to make a wager;

dealing hands by the dealer consecutively to all the players including the banker, the dealer receiving no cards, starting from a player directly adjacent to the banker such that each player and the banker have hands including two initial cards;

wherein each player obtains a card point total determined by the summation of the value of the cards in his hand, wherein numbered cards are worth their face value, face cards are worth ten and aces are worth one or eleven;

allowing each player starting with the player directly adjacent to the banker, to receive additional cards in his hand, one at a time, thereby affecting his card point total until the player elects to receive no more additional cards or until the player's card point total exceeds twenty-one wherein the player loses his wager to the banker and that player is out of the game;

wherein the banker must elect to receive an additional card if his card total is less than 17 and wherein the banker must stand if his card total is greater than 16;

wherein the player has a winning hand if his card point total is less than twenty-two and is closer to twenty one than the card point total of the banker;

wherein the hand is a tie if the player and the banker have the same card point total less than twenty-two unless the player or the banker has a card point total of twenty-one based solely on the initial cards; and wherein the player has a losing hand if he has a card point total over twenty-one or if his card point total is further from twenty-one than the card point total of the banker;

paying by the banker to the players with winning hands in accord with traditional blackjack payoff rules;

collecting the wagers by the banker from the players with losing hands;

determining a vigorish based, at least in part, on all wagers collected by the banker from the players; and paying the vigorish to the dealer.

2. The method of playing a casino card game in accord with claim 1 wherein the vigorish is determined based on the net wagers collected by the banker.

3. The method of playing a casino card game in accord with claim 1 further comprising:

dealing the initial cards to the players face down and dealing at least one of initial cards to the banker face up.

4. The method of playing a casino card game in accord with claim 1 further comprising:

dealing the initial cards to the players face up and dealing at least one of the initial cards to the banker face up.

5. The method of playing a casino card game in accord with claim 1 further comprising:

dealing the initial cards to the banker face up wherein the player receives a payoff at one-to-one odds for a winning blackjack hand and the banker wins all ties.

6. The method of playing a casino card game in accord with claim 1 further comprising:

paying by the dealer a predetermined portion of the bets won by the players; and collecting by the dealer a predetermined portion of the bets lost by the players.

7. The method of playing a casino card game in accord with claim 1 further comprising:

permitting a player with a matching pair of cards in his initial two cards to split the pair into two separate new hands, each new hand including one of the two cards of the pair.

8. The method of playing a casino card game of claim 1 in accord with claim 1 further permitting the player to double his wager after receiving his initial cards and dealing the player only one additional card.

9. The method of claim 1 further comprising a first hand including:

requiring a wager by all the players;

if no player accepts the role of the banker, dealing an initial two-card hand by the dealer to the players and the dealer;

allowing each player to receive additional cards from the dealer, at the player's option or until the player exceeds a card point total of twenty-one;

collecting by the dealer of the wagers of any player receiving a card point total over twenty-one;

comparing each remaining player's hands with the hand of the dealer and designating the player's hand as a winner or a loser in accord with the rules of blackjack;

paying off by the dealer to the players with winning hands in accord with the rules of blackjack; and collecting by the dealer of the wagers of the players with losing hands.

10. A method of playing a version of blackjack with a dealer employed by the casino and a plurality of players positioned about a table in an order with respect to the dealer, the method comprising:

providing at least one standard deck of 52 playing cards;

offering each player, in turn, from a position adjacent to the dealer, the role of banker until a player accepts the banker's role;

designating the accepting player as banker;

requiring each of the players excluding the banker to make a wager;

dealing an initial two card blackjack hand by the dealer to each player and the banker starting from a player directly adjacent to the banker, wherein each hand has a card point total based on the cards in the hand;

allowing each player, starting with the player directly adjacent to the banker, to play out his blackjack hand against the banker by electing to receive additional cards to achieve a desired card point total and comparing the card point total if the player to a card point total of the banker, wherein the banker must receive an additional card if his card point total is less than seventeen and may not receive an additional card if his card point total is above sixteen, and wherein a player is a loser if his card point total exceeds twenty-one;

comparing the card point totals of the hand of the players to the card point total of the banker and designating the player's hand as winning or losing based on this comparison, wherein the player has a winning hand if his card point total is closer to twenty-one then the banker's card point total and wherein the player has a losing hand if the banker's card point total is closer to twenty one than the player's card point total;

paying by the banker to the players with winning hands in accord with traditional blackjack payoff rules;

collecting the wagers by the banker from the players with losing hands;

determining a vigorish as a predetermined portion of all net wagers collected by the banker from the players;

collecting the vigorish by the dealer; and again offering each player, in turn, from a position adjacent to the dealer, the role of banker until a player accepts the banker's role.

11. The method of playing a casino card game in accord with claim 10 further comprising:

dealing an initial two cards to the players face down and dealing at least one of an initial two cards to the banker face up.

12. The method of playing a casino card game in accord with claim 10 further comprising:

dealing an initial two cards to the players face up and dealing at least one of an initial two cards to the banker face up.

13. The method of playing a casino card game in accord with claim 10 further comprising:

dealing an initial two cards to the banker face up wherein the player receives a payoff at one-to-one odds for a winning blackjack hand and the banker wins all ties.

14. The method of playing a casino card game in accord with claim 10 further comprising:

paying by the dealer a predetermined portion of the bets won by the players; and collecting by the dealer a predetermined portion of the bets lost by the players.

15. The method of playing a casino card game in accord with claim 10 further comprising:

permitting a player with a matching pair of cards in his initial cards to split the pair into two separate new hands, each new hand including one of the two cards of the pair.

16. The method of playing a casino card game of claim 10 further comprising permitting the player to increase his wager after receiving his original two cards and dealing the player only one additional card.

17. The method of claim 10 further comprising a separate hand when no player accepts role of banker including:

requiring a wager by all the players;

dealing an initial two-card hand by the dealer to the players and the dealer;

allowing each player to receive additional cards from the dealer, at the player's option or until the player exceeds a card point total of twenty-one;

collecting by the dealer of the wagers of any player receiving a card point total over twenty-one;

comparing each remaining player's hands with the hand of the dealer and designating the player's hand as a winner or a loser in accord with the rules of blackjack;

paying off by the dealer to the players with winning hands in accord with the rules of blackjack;

collecting by the dealer of the wagers of the players with losing hands.

18. A method of playing casino blackjack using at least one standard deck of 52 playing cards wherein players receive a card point total equaling the point value of numbered cards, ten points for face cards and one or eleven points for aces, the method comprising:

positioning a plurality of players in an order at a table;

positioning a dealer employed by the casino at the table among the players;

offering each player, in turn, the role of banker until a first player accepts;

designating the first player as banker;

providing a wager by each player, excluding the banker;

dealing of initial two-card blackjack hands by the dealer to the players, including the banker and excluding the dealer, in order starting from a player adjacent to the banker;

allowing each player to receive additional cards from the dealer, at the player's option or until the player exceeds a card point total of twenty-one, starting from the player adjacent to the banker;

collecting by the banker of the wagers of any player receiving a card point total over twenty-one wherein any player with a card point total over twenty-one is out of the game;

comparing each remaining player's hands with the hand of the banker and designating the player's hand as a winner or a loser in accord with the rules of blackjack, wherein for the purposes of comparison, the banker is deemed to be the house;

paying off by the banker to the players with winning hands in accord with the rules of blackjack;

collecting by the banker of the wagers of the players with losing hands;

paying by the banker to the dealer a vigorish on any wagers collected by the banker.

19. The method of claim 18 further comprising a first hand including:

requiring a wager by all the players;

if no player accepts the role of banker, dealing an initial two-card hand by the dealer to the players and the dealer;

allowing each player to receive additional cards from the dealer, at the player's option or until the player exceeds a card point total of twenty-one;

collecting by the dealer of the wagers of any player receiving a card point total over twenty-one;

comparing each remaining player's hands with the hand of the dealer and designating the player's hand as a winner or a loser in accord with the rules of blackjack;

paying off by the dealer to the players with winning hands in accord with the rules of blackjack;

collecting by the dealer of the wagers of the players with losing hands.

20. The method of claim 19 wherein the vigorish is 5% of the net wagers collected by the banker.

* * * * *